United States Patent [19]

Cleary et al.

[11] Patent Number: 4,911,226

[45] Date of Patent: Mar. 27, 1990

[54] METHOD AND APPARATUS FOR CONTINUOUSLY CASTING STRIP STEEL

[75] Inventors: John E. Cleary, Medina, Ohio; Frank A. Hultgren, Lakeville, Minn.

[73] Assignee: The Standard Oil Company, Cleveland, Ohio

[21] Appl. No.: 231,514

[22] Filed: Aug. 12, 1988

Related U.S. Application Data

[63] Continuation-in-part of Ser. No. 85,513, Aug. 13, 1987, abandoned.

[51] Int. Cl.[4] ..... B22D 11/00

[52] U.S. Cl. ..... 164/478; 164/418; 164/484

[58] Field of Search ..... 164/484, 418, 459, 478

[56] References Cited

U.S. PATENT DOCUMENTS 2,171,132 8/1939 Simons .
2,553,921 5/1951 Jordan .
3,354,936 11/1967 Atkin .
3,580,325 5/1971 Schrewe .
3,702,154 11/1972 Rokop et al. .
3,746,077 7/1973 Lohikoski et al. .
3,872,913 3/1975 Lohikoski .
4,073,333 2/1978 Korshunov et al. .
4,232,727 11/1980 Bower et al. .
4,307,770 12/1981 Shinopulos et al. .
4,612,971 9/1986 Bower et al. .

FOREIGN PATENT DOCUMENTS 58-187243 1/1983 Japan .

*Primary Examiner*—Kuang Y. Lin
*Attorney, Agent, or Firm*—Weston, Hurd, Fallon, Paisley & Howley

[57] ABSTRACT

Strip steel is continuously cast by immersing a mold into a melt of liquid steel, solidifying liquid steel on a starter bar disposed within the mold, and oscillating the mold as the starter bar is withdrawn upwardly from the mold. The mold includes, at its lower end, an insulating ceramic entry die. The remainder of the interior surface of the mold is defined by a water cooled copper or copper alloy liner. The mold can be vertical or it can be inclined at an angle to the horizontal in order to facilitate feeding strip steel directly into a rolling mill or hot coiler. Alternatively, the interior of the mold can be curved so that strip steel issuing from the mold is directed horizontally into the rolling mill or hot coiler.

28 Claims, 7 Drawing Sheets

METHOD AND APPARATUS FOR CONTINUOUSLY CASTING STRIP STEEL

This is a continuation-in-part of application Ser. No. 085,513, filed Aug. 13, 1987, now abandoned.

BACKGROUND OF THE INVENTION

1. Field of the Invention

The invention relates to the production of strip steel and, more particularly, to a technique for continuously casting strip steel.

2. Description of the Prior Art

Early steel making processes produced steel slabs in batches. A quantity of liquid steel was poured into individual cast iron molds where solidification into ingots occurred. After cropping and surface conditioning treatments to remove inclusions and surface imperfections, the ingots were rolled into slabs which thereafter were rolled into sheets or strips. As used herein, the terms "strip" or "strip steel" will refer to any finished, or semi-finished, or near-finished steel product having a rectangular cross-section with a width substantially greater than its thickness. Finished strip steel typically has a thickness of 0.015–0.150 inch.

A problem with batch, or ingot, casting is that the steel is poured through air into the molds. Unfortunately, when liquid steel is contacted with air, it is highly vulnerable to re-oxidation, a condition which produces large quantities of solid oxide inclusions. Although most of the inclusions float to the top of the ingot as the ingot solidifies, it still is necessary to crop 10–20 percent from the top of the ingot in order to remove the inclusions. Surface conditioning removes another 1–4 percent of the ingot. The overall slab-producing process is slow and costly because the slabs are produced from individual ingots and because losses are high.

Techniques recently have been developed for continuously casting steel slabs. These techniques also substantially eliminate re-oxidation, thereby greatly increasing the quality of the as-cast slabs. In a typical continuous casting operation, liquid steel is poured through air into a reservoir known as a tundish where inclusions float to the surface. The liquid steel is fed by gravity from the bottom of the tundish through a ceramic nozzle into a cooled, vertically extending, open-ended mold. The steel is backed up in the mold so that the lower end of the nozzle always is immersed in liquid steel, thereby preventing re-oxidation. Upon oscillating the mold, steel being solidified in the mold will be withdrawn from the bottom of the mold. By appropriate control of process parameters such as pour rate, rate of heat removal, and oscillation rate, slabs can be cast continuously at 30–80 inches per minute. The resultant slabs are of very high quality.

Despite the significant advances made by continuous casting processes, several problems have not been addressed adequately. One of the problems relates to the expense of the equipment needed to process the slabs. The capital costs for a rolling mill to convert the slabs into strip is on the order of $350–500 million (1984–85 dollars). The expense is so great because it is difficult to reduce the relatively thick slabs to thin strips. Unfortunately, the slabs cannot be made thinner than about 6–10 inches. This is because the nozzle must extend into the mold so that re-oxidation is prevented. A nozzle typically has a minimum outer diameter of about 4.0 to 5.0 inches. It has been found impractical to produce nozzle-accommodating molds having a thickness less than about 6–10 inches.

The practical consequence of producing a slab having a thickness of about 6–10 inches is that the slab must be reduced to about 1/100 of its original thickness to form strip. The expense of the equipment needed to perform such a large reduction is significant. Accordingly, although high quality slabs can be produced at high production rates by a continuous caster, the expense of the equipment needed to handle the slabs is greater than ever.

A recent attempt to deal with the noted problems is the "thin slab" caster of Con-Cast of Montvale, N.J. In this caster, the upper end of the mold is configured to more closely approximate the external configuration of the nozzle. The upper end of the mold also is tapered to produce a slab having a thickness of approximately 1½–2 inches. The capital costs of the rolling mill equipment needed to handle a slab produced by the thin slab process is greatly reduced, on the order of $100 million. Also, production speeds are improved, on the order of 140–180 inches per minute. However, the thin slab process suffers from a drawback common to all gravity-fed casting processes wherein a "breakout," or loss of liquid steel, can occur in the event of a mold rupture or other equipment failure.

Another attempt to deal with the noted problems is the so-called horizontal caster. In this approach, the mold is connected to an opening in the side of the tundish by means of a refractory joint known as a break ring. Liquid steel is fed by gravity from the tundish into the mold. Unfortunately, due to the break ring connection between the tundish and the mold, the mold cannot be oscillated independently of the tundish. Also, if flow problems occur in the mold or in the break ring, the entire tundish must be drained. Horizontal casting also is subject to break out problems, as well as to problems related to maintaining surface quality and uniformity of cross-section in the resultant slab. The horizontal casting technique has been found to be suitable only for the production of billets (having a square or near-square cross-section) rather than thin slabs or sheets.

It also is known to cast metal in an upward direction. One early attempt is disclosed in U.S. Pat. No. 2,553,921 issued May 22, 1951 to J. F. Jordan. Jordan discloses a water-cooled, metallic "mold pipe" having an outer ceramic covering that is immersed in a melt. A starter bar is inserted into the mold prior to the beginning of a casting operation. The starter bar is withdrawn from the mold in order to pull solidified metal from the melt. Jordan does not address various problems, such as how to arrange the ceramic covering relative to the mold pipe in order to successfully cast steel. Jordan also fails to address such problems as how to efficiently cool the mold and how to direct the newly cast metal into equipment positioned downstream of the mold.

Other up-casting techniques are disclosed in U.S. Pat. No. 3,746,077 issued May 12, 1971 to T. J. J. Lohikoski, et al. and U.S. Pat. No. 3,872,913, issued Mar. 25, 1975 to T. J. J. Lohikoski. In the '913 patent, the problems associated with thermal expansion differences are avoided by placing only the tip of a "nozzle" in the melt. A water-cooled jacket encloses the upper end of the nozzle. Because the surface of the melt is below the cooling zone, a vacuum chamber at the upper end of the nozzle is necessary to draw the melt upwardly to the cooling zone. The presence of the vacuum chamber limits the rate of strand withdrawl and requires a seal.

The '077 patent avoids the vacuum chamber by immersing a cooling jacket and a portion of an enclosed nozzle into the melt. The immersion depth is sufficient to feed melt to the solidification zone, but it is not deeply immersed. The jacket, as well as the interface between the jacket and the nozzle, are protected against the melt by a surrounding insulating lining. The lower end of the lining abuts the lower outer surface of the nozzle to block a direct flow of the melt to the cooling jacket. Both the '913 and the '077 patents suffer from the drawback that a gap exists between the inner surface of the mold and the outer surface of the newly cast metal. Accordingly, the metal is cooled inefficiently by means of radiation cooling.

The foregoing systems commonly are characterized as "closed" molds in that the liquid metal communicates directly with the solidification front. The cooled mold typically is fed from an adjoining container filled with the melt. In contrast, an "open" mold system feeds the melt, typically by a delivery tube, directly to a mold where it is cooled very rapidly. Open mold systems commonly are used in downcasting large billets of steel and occasionally aluminum, copper, or brass. However, open mold casting is not used to form products with a small cross-section because it is very difficult to control the liquid level and hence the location of the solidification front. Also, if steel is being cast, many steel grades require the total absence of air during mold entry. It is very difficult to protect the entry stream of molten steel from contacting air during continuous pouring into open molds of small cross-section.

Yet additional approaches to the upcasting of metal are known. These additional techniques primarily are directed to copper and brass castings. The references in question are U.S. Pat. No. 4,232,727, issued Nov. 11, 1980 to Terry F. Bower, et al., U.S. Pat. No. 4,307,770, issued Dec. 29, 1981 to George Shinopulos, et al., and U.S. Pat. No. 4,612,971, issued Sept. 23, 1986 to Terry F. Bower, et al. The '727 patent describes a method and apparatus for the continuous production of strip from a cast rod in which the rod is drawn through a mold from a melt in the pattern of forward and reverse strokes. The '770 patent is directed to a particular mold assembly for upcasting strands of copper alloys such as brass wherein a refractory insulating means is provided between the mold cooling means and the die. The '971 patent discloses a continuous method for production of metallic strip from a melt which includes regulating the speed of a metallic rod to maintain a substantially constant forward speed before the rod is converted to strip, the regulation being accomplished by (1) changing the direction of travel of the rod after emergence from a chilled mold, (2) permitting slack through lateral deflections of the rod, and (3) advancing the rod in a manner to control the slack.

Since the ultimate product of the process is to be a metal strip having a width substantially greater than its thickness, it would be useful to provide a mold have a near-net shape cross-section. This would greatly reduce the amount of hot rolling required to produce the final strip of material. Since the hot rolling process generally is conducted in a horizontal plane, it would be well if some means could be found to provide a transition from the direction of mold issuance to a horizontal plane.

Most desirably, a technique would be found that would enable strip steel to be cast directly from the tundish, thereby minimizing the expense of the rolling equipment needed to finish the steel. Hopefully the technique would avoid re-oxidation and breakout problems, as well as other problems associated with prior continuous casting techniques.

SUMMARY OF THE INVENTION

The present invention overcomes the foregoing and other drawbacks of the prior art by providing a new and improved method and apparatus for continuously casting strip steel. The invention employs a cooled mold which is inserted into liquid steel maintained in a tundish or similar container. The mold has a through opening with a thin rectangular cross-section. The mold is inserted far enough beneath the surface of the liquid that liquid steel rises up into the mold. A starter bar is inserted into the upper end of the mold to form a solidification front. Upon oscillating the mold and withdrawing the starter bar upwardly, strip steel will be continuously produced from the mold. It is expected that strip as thin as 0.1875–0.25 inch can be produced at the rate of 150–500 inches per minute.

In the preferred embodiment of the invention, the mold includes a rectangular ceramic entry die. The remainder of the through opening is defined by a water-cooled copper or copper alloy liner. The entry die is joined to the liner in end-to-end abutting relationship with substantial surface-to-surface contact to form a smooth-sided through opening. The mold is vertical, or it is inclined upwardly at an angle of not less than 15 degrees above the horizontal and typically about 35 or more degrees above the horizontal. The through opening can be straight, or it can be curved in order to direct the strip more horizontally for easier transition to rolling mill equipment or hot coiling equipment.

Because the lower end of the mold is always disposed beneath the upper surface of the liquid steel, the invention completely eliminates re-oxidation. Moreover, because it is not necessary for a nozzle to direct the liquid steel into the mold, there is no geometrical constraint on the thickness of the mold. The only limitation is that the resultant strip should not be too thin; it should be thick enough to undergo a reduction of between 2:1–10:1 in order to insure acceptable metallurgical properties for the finished product. The invention also eliminates the reoxidation and break out problems associated with various prior continuous casters. The invention permits independent mold oscillation without a fixed joint (break ring) connecting the mold to the tundish as in horizontal casting. Because the mold is not connected to the tundish, mold changes can be accomplished easily. Probably the most significant advantage of the present invention is that the cost of the rolling mill equipment needed to process the strip is far less than with any prior steelcasting techniques, on the order of $15 million.

The foregoing, and other features and advantages of the invention, will become apparent to those skilled in the art from reviewing the accompanying specification and drawings.

DESCRIPTION OF THE PREFERRED EMBODIMENT

Figure 1:
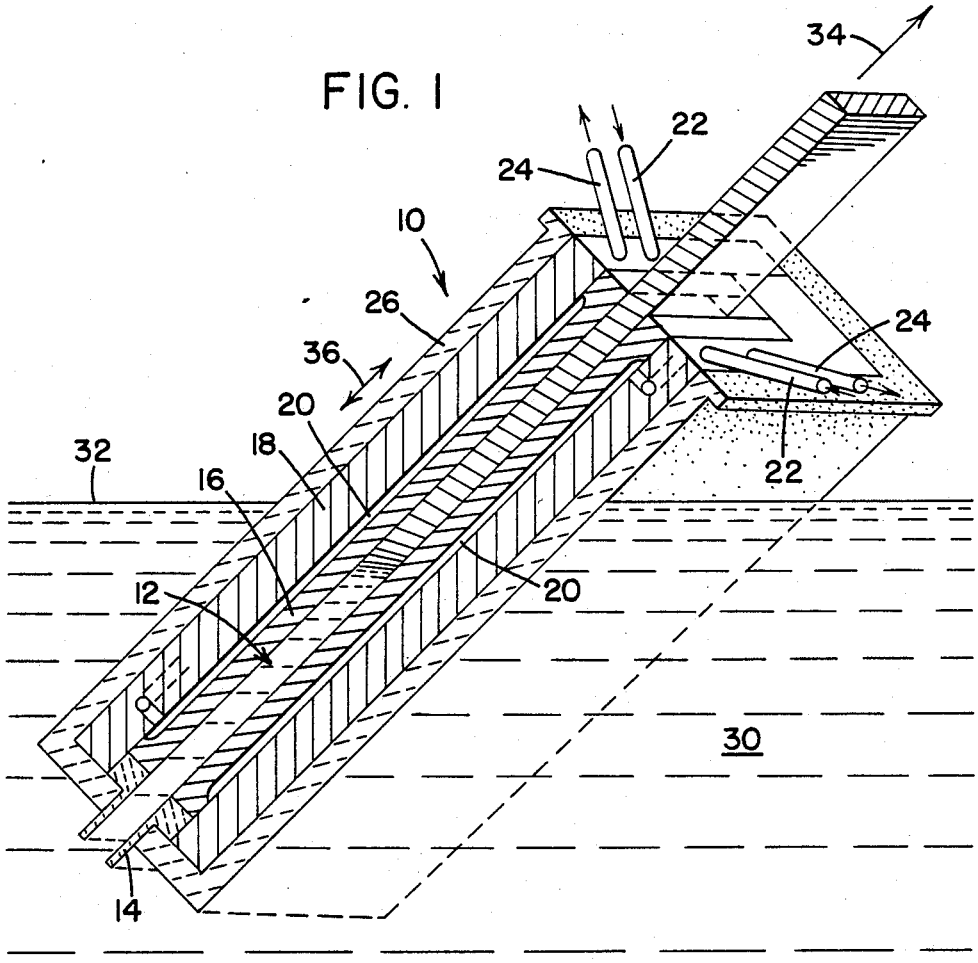
FIG. 1 is a perspective view with full length section showing the structure and orientation of a mold embodying the present invention.

Referring to FIG. 1, there is shown a mold 10 partially immersed in a melt or bath 30 of liquid steel. The mold 10 includes a through opening, or cavity 12, having a thin rectangular cross-section. The opening 12 preferably is smoothly tapered from a larger entrance end to a smaller exit end in order to accommodate shrinkage of the steel as it is cooled during its passage through the mold 10. If desired, the opening 12 can have a constant cross-section throughout its length. The thickness of the resultant strip is exaggerated in FIGS. 1 and 2 so that the various features of the mold 10 can be seen more clearly.

An insulating entry die 14 defines the entrance end of the opening 12, while the remainder of the opening 12 is defined by a multi-part liner 16. The entry die 14 is joined to the liner 16 in end-to-end abutting relationship with substantial surface-to-surface contact to form a smooth-sided through opening 12. The entry die 14 is made of a refractory material such as fused silica, boron nitride, or alumina graphite which can withstand the thermal shock generated by the casting process. The liner 16 is made of a metal having exceptionally good thermal conductivity characteristics, such as copper or a copper alloy. The liner 16 is tightly enclosed within a housing 18. The housing 18 preferably is formed of a strong material such as stainless steel which can retain its strength at the high temperatures involved.

A plurality of passages 20, 21 (FIG. 5) are provided at the interface between the liner 16 and the housing 18. The passages 20 consist of a series of grooves machined or cast in the exterior surface of the liner 16; the passages 21 consist of a series of grooves machined or cast in the interior surface of the housing 18. The housing 18, in its tight-fitting relationship with liner 16, closes and seals the grooves forming the passages 20, 21. Water or other acceptable cooling fluid is directed through the passages 20, 21 by means of inlets 22 and outlets 24 in order to dissipate the heat extracted by the liner 16 from the steel. A more detailed description of the means by which the liner 16 is cooled is set forth below in connection with the description of FIG. 5.

A ceramic, outer protective armor 26 encloses the housing 18 and forms the outer structure of the mold 10. It will be noted that the protective armor completely covers the sides and bottom of the mold 10 except where the lower end of the entry die 14 extends through it. It also will be noted that the die 14 can be completely disposed within the lower end of the mold 10, if desired.

In FIG. 1, the mold 10 is shown partially immersed in the bath 30 of molten steel and the extent to which the mold 10 is immersed is indicated by the liquid level 32. The casting direction of the steel through the opening 12 is indicated by the arrow 34, while the direction of oscillation of the mold assembly is indicate by the arrow 36. In effect, the mold 10 is oscillated along the longitudinal axis of the opening 12. The mold 10 is immersed in the bath 30 at an angle equal to or greater than 15 degrees from the horizontal and, as shown in FIG. 1, is inclined at an angle of 45 degrees. Thus, the steel strip in passing through the opening 12 will emerge therefrom at an angle of 45 degrees to the horizontal, thereby facilitating entry into a horizontally oriented hot rolling mill or a hot coiler. The mold 10 can also be positioned vertically, if desired.

Figure 2:
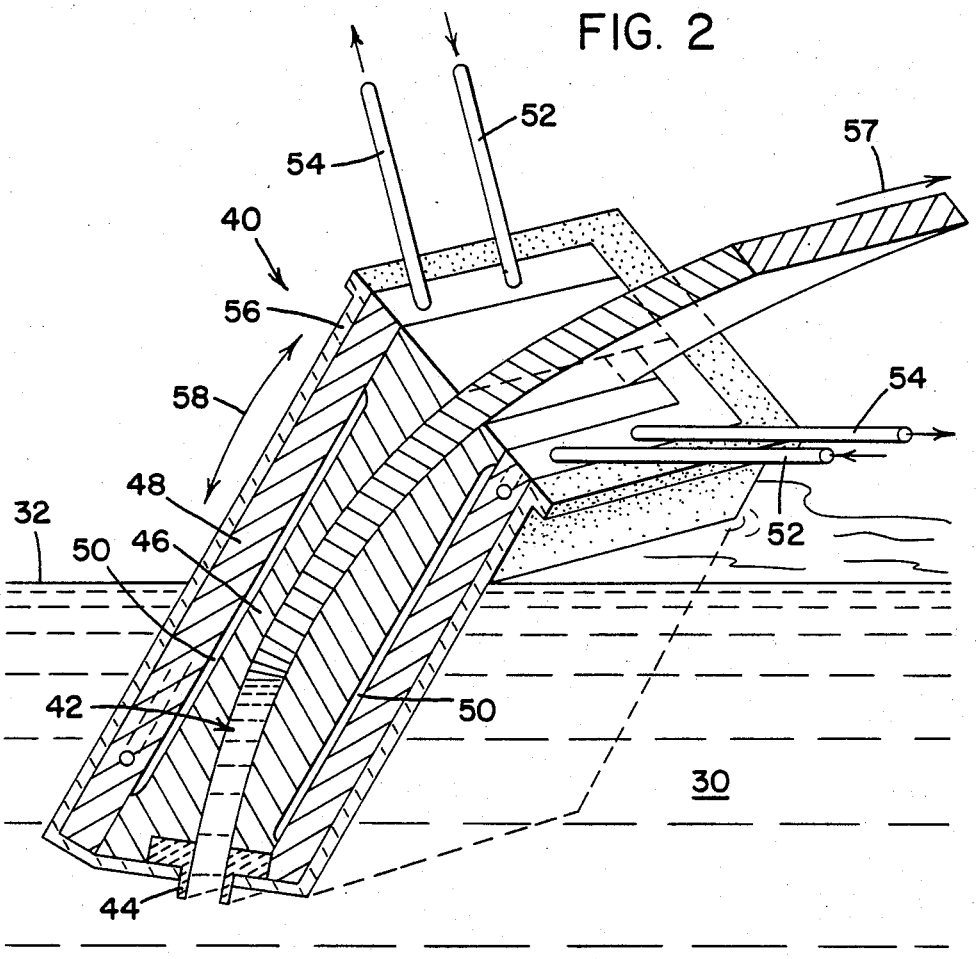
FIG. 2 is a view of a mold similar to that of FIG. 1 with, however, a curved mold cavity.

Referring to FIG. 2, there is illustrated a mold 40 having a curved through opening 42 which imparts a curvature to the cast steel issuing from the mold 40. The mold 40 is substantially identical to the mold 10 except for the shape of the components needed to produce the curved through opening 42. Thus, there is an entry die 44, a multi-part liner 46, and a housing 48 within which the liner 46 is disposed. Between the exterior surface of the liner 46 and the interior surface of the housing 48, passages 50 are provided in the form of grooves machined or cast in the exterior surface of the liner 46, while the housing 48 provides sealing surfaces for the passages 50. Inlets 52 and outlets 54 enable water or other cooling fluid to be circulated through the passages 50. Ceramic outer protective armor 56 surrounds the housing 48 to protect the housing 48 from attack by the molten steel in which it is partially immersed.

The casting direction indicated by the arrow 57 shows that the steel strand has a curvature as it leaves the mold 40. An arrow 58 indicating the oscillation direction shows that this oscillation is arranged along an arcuate path to facilitate movement of the steel through the opening 42. As with the mold 10, the mold 40 is oscillated along the longitudinal axis of the opening 42. The mold 40 is also inclined upwardly 60 degrees from the horizontal. This inclination and the curvature of the opening 42 give the steel strip an orientation closely approaching the horizontal as it reaches the horizontal rolling mill or hot coiling equipment. If desired, the mold 40 can be positioned vertically.

The withdrawal of high quality strip cast at high speeds is facilitated by forward and reverse strokes applied to the molds 10, 40 by an oscillator (not shown). It is believed that forward and reverse strokes of equal displacement and acceleration will be adequate to produce high quality strip. The frequency of the oscillation cycle will be relatively high, approximately 100–500 cycles per minute (cpm). At an amplitude of 0.25 inch, an oscillation cycle of 3.0 to 4.0 times the casting speed in inches per minute will reduce or eliminate friction-caused transverse cracking in low and medium carbon steels.

It is also possible that a special oscillation cycle could be used. For example, the forward strokes can be characterized by a high forward velocity and long stroke length. The reverse strokes can be characterized by a comparatively short stroke length in the direction of casting at a speed equal to the casting speed. Both the forward and reverse strokes also can be characterized by high accelerations, typically greater than the acceleration of gravity (1 g). It may be advantageous to provide a dwell period (a period in which the molds 10, 40 are at rest) after the reverse stroke. The reverse stroke and dwell period should allow "healing time" for the new skin of solidified metal to form adjacent the die. The forward strokes advance the casting and expose the solidification zone within the mold to fresh molten metal. A dwell period also may be used after the forward stroke to prevent buckling in the solidification zone during the reverse stroke. The frequency of the cycle is relatively low, less than 200 cpm and preferably in the range of 60 to 200 cpm. Frequencies in excess of 200 cpm utilizing this special cycle may lead to fracture of the strip.

Figure 3:
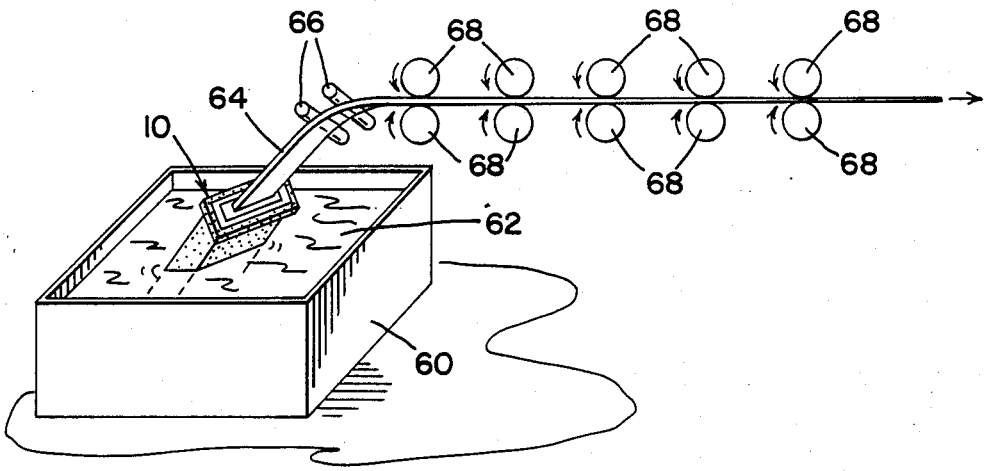
FIG. 3 is a schematic view of a continuous process for casting and hot rolling strip using the mold of FIG. 1.

In FIG. 3, a continuous process for casting steel strip is shown. A tundish 60 is filled with molten steel 62 to be cast. A start-up steel strip, or starter bar, of approximately the dimensions of the strip to be cast is fed down into the mold 10 and is engaged by the withdrawal mechanism (not shown). The mold 10 is inserted into the melt 62 at an angle of more than 15 degrees from the horizontal. The starter bar is extended into the mold 10 within the opening 12. The melt solidifies on the starter bar and a strip 64 is drawn through the opening 12. When a sufficient length of the strip 44 has emerged from the mold 10, the strip 64 is sheared below the starter bar and the starter bar is removed for future use. The strip 64 eventually contacts bending rolls 66 which force the strip 64 to a generally horizontal path to enter the hot rolling mill indicated by the rolls 68 in which the strip 64 is reduced to a desired thickness.

Figure 4:
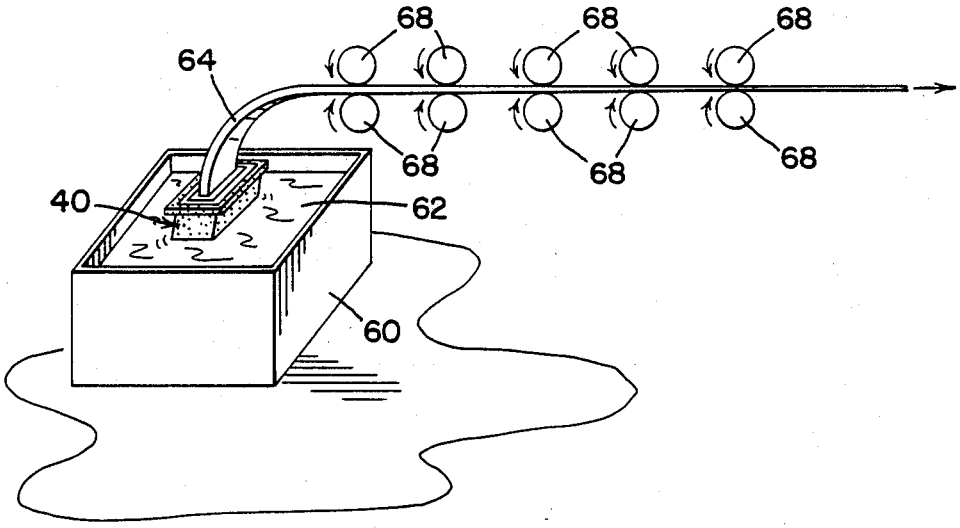
FIG. 4 is a schematic view of a continuous process similar to that of FIG. 3 employing the mold of FIG. 2.

FIG. 4 illustrates a very similar continuous casting and hot rolling process to that shown in FIG. 3 in which the mold 40 is used. Again the tundish 60 is filled with a molten metal bath 62 in which the mold 40 is partially immersed. The steel strip 64 issues from the top of the mold 40 having a curvature developed in its passage through the mold 40 and smoothly enters the horizontal rolling mill 68.

As the strand is withdrawn upwardly from either of the molds 10, 40, forward mold strokes pull the mold downwardly to expose molten steel to the cooled liner which quickly forms a skin on this newly exposed surface. The reverse strokes allow the new skin to strengthen and attach to the previously formed casting. Because of the high cooling rate of the liner, surface solidification occurs very rapidly over a relatively short length of the mold. Typical melt temperatures for alloy steels are 2720° F. to 2785° F. It is believed that the entry die insulates the steel from the liner to maintain the steel adjacent the lower end of the mold near the melt temperature, while the temperature of the steel adjacent the liner drops rapidly.

In casting carbon or alloy steel strip at about 200 inches per minute, the solidification zone extends longitudinally of the mold for about 6 to 20 inches. At the top of the solidification zone, the steel is solid. At the bottom of the solidification zone, the steel is liquid. Estimated average temperature of the steel within in the solidification zone is in the range of 2720° F. to 2820° F. A typical temperature for steel leaving the mold is 2250° F. The characteristics of the steel strip leaving the mold are fine grain size, good tensile strength, good ductility and a smooth surface suitable for hot reduction in a hot rolling mill without further treatment. Hot rolling is appropriate if the thickness of the cast strip is greater than about 0.25 inch. Cold rolling of cast strip 0.25 inch and thinner may be accomplished after suitable pickling or other scale removal technique.

Figure 5:
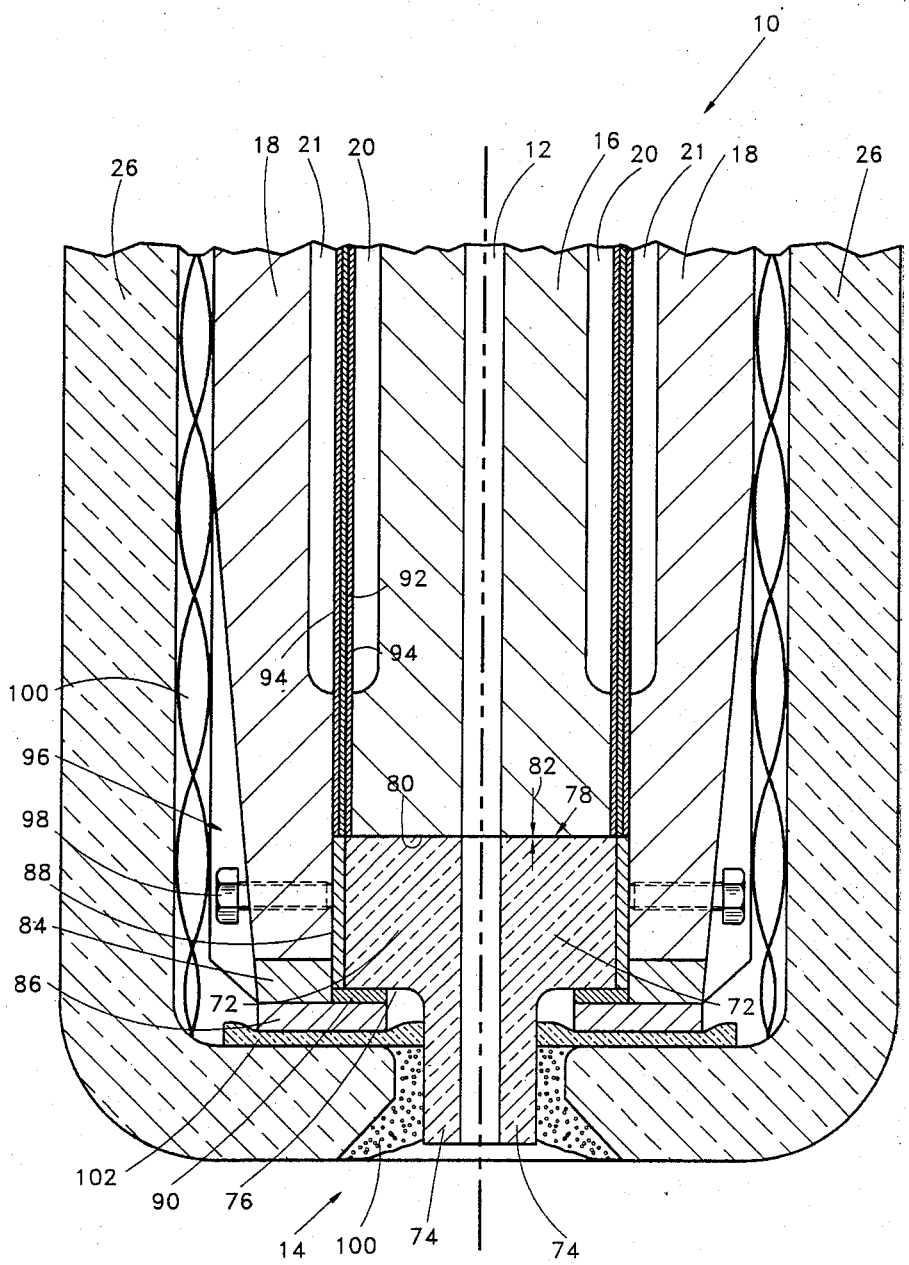
FIG. 5 is an enlarged view of a portion of the mold of FIG. 1 showing the entry portion of the mold in detail.

Referring now to FIG. 5, the entry portion of the mold 10 is shown in detail. The reference numerals used in FIG. 1 are carried over, where appropriate, to FIG. 5. The entry die 14 is provided in two identical halves which are joined together to provide a smooth-sided through opening 12. Each half of the entry die 14 includes a body portion 72 and a relatively thin projecting portion 74. The projecting portion 74 is necked down relative to the body portion 72 so as to define a shoulder 76. The base of the body portion 72 defines a smooth face 78. Similarly, that portion of the liner 16 facing the entry die 14 includes a smooth face 80.

The gap between the faces 78 and 80 is indicated in FIG. 5 by the reference numeral 82. It is important that this gap be as small as possible so that, desirably, the entry die 14 and the liner 16 engage each other in end-to-end, abutting relationship with substantial surface-to-surface contact. It has been discovered that if a gap larger than about 0.005 inch exists, molten metal will fill the gap and solidify to form a "fin". Upon being pulled from gap, the fin will create excessive drag. That drag will cause the metal to separate and halt the casting process. Even if the casting process is not stopped initially, the molten steel will enlarge the gap so that succeeding fins will grow in length and thickness, eventually reaching the point where the casting process will be halted. Accordingly, it is important that the gap 82 be maintained on the order of 0.005 inch or smaller.

Plate 84 is fitted at the end of housing 18. Similarly, plate 86 is fitted at the end of plate 84. Shims 88 are fitted between the outer surface of the body portion 72 and the inner surface of the housing 18 and the plate 84. Shims 90 are fitted between the shoulder 76 and the end surface of the shims 88 and the inner surface of the plate 86. The shims 88 permit an adjustment in the lateral positioning of the entry die 14, while the shims 90 permit a vertical, or endwise, adjustment of the entry die 14.

Brass shims 92 are disposed intermediate the liner 16 and the housing 18. Water-sealing gaskets 94 of siliconized rubber such as VITON or other high temperature sealing material are disposed on either side of the shims 92 and engage the liner 16 and the housing 18. The shims 94 create a water-tight seal, while the shims 92 provides stiffness for the shims 94. The shims 92, 94 divide the passages 20, 21 from each other so that cool water can be directed through the passages 21 from the inlets 22. Water then can be directed through the passages 20 from the passages 21 and out of the outlets 24. In order to accomplish this result, openings (not shown) are formed in the shims 92, 94 near the top and bottom of the passages 20, 21 so as to connect the passages 20, 21. Alternatively, the passages 21 could be eliminated and the passages 20 could be connected in serpentine fashion. If this alternative is elected, only one of the shims 94 would be needed in order to provide an acceptable seal.

Slot 96 are provided in the outer surface of the housing 18. Screws 98 are fitted into the slots 96 and through threaded openings in the housing 18. The ends of the screws 98 bear against the shims. The screws 98 enable the entry die 14 to be rigidly secured in a proper position relative to the liner 16. Similarly, screws (not shown) extend through the plates 84,86 and into the housing 18. By this construction, a positive seating pressure can be applied to the shoulder 76 and to the surfaces 78,80 so as to minimize or eliminate the gap 82.

The mold 10 includes at least one layer of ceramic cloth insulation 100 that is wrapped around the housing 18 intermediate the housing 18 and the inner surface of the ceramic armor 26. The cloth insulation 100 reduces heat flow from the armor 26 to the housing 18 so as to increase the efficiency of the cooling water. A thin, compressible gasket 102 of ceramic felt material is disposed intermediate the plate 86 and the inner end surface of the ceramic armor 26. In use, the ceramic armor 26 is pulled tight against the plate 86, and the felt material 102 cushions the assembly against the resultant vertical tension. The felt material 102 also acts to block leakage of liquid steel into the inside of the armor 26. A ceramic slurry 104 is disposed intermediate the outer surface of the end of the projecting portion 74 and the opening formed at the end of the ceramic armor 26. When the slurry 104 dries, it forms an additional ceramic barrier to the steel.

Figure 6:
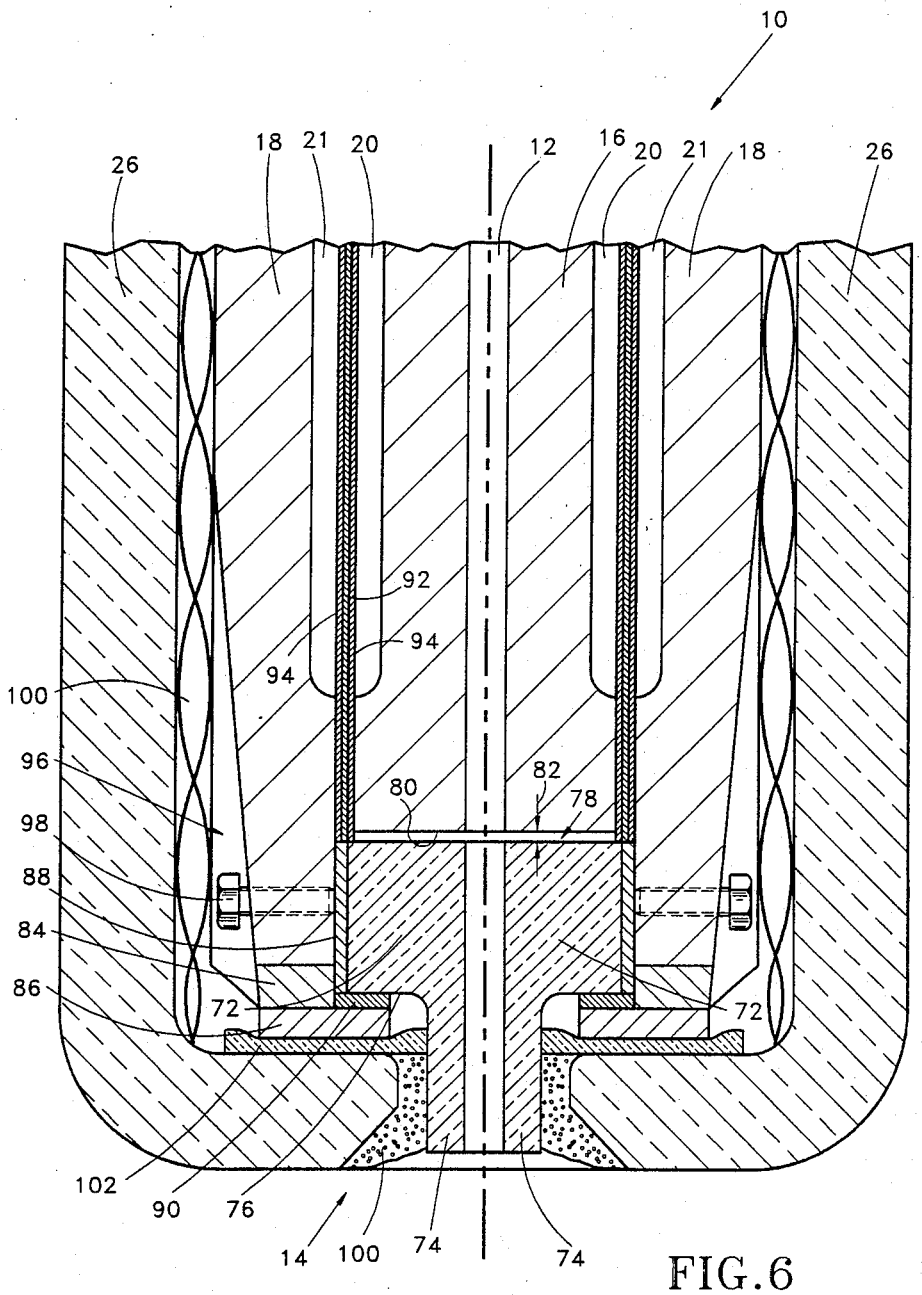
FIG. 6 is a view similar to FIG. 5 showing an undesired gap between an entry die and liner.
Figure 9:
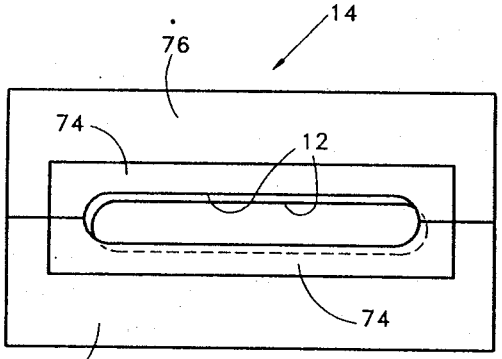
FIG. 9 is a schematic end view of the mold of FIG. 1 showing an undesired misalignment of the entry die and the liner.
Figure 10:
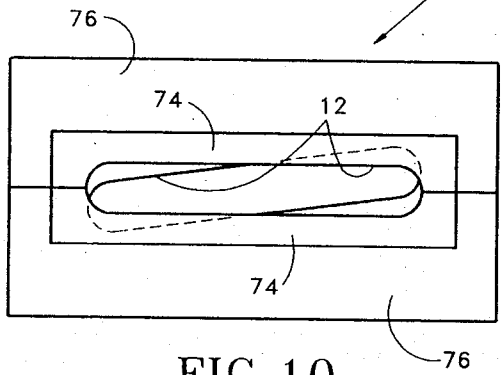
FIG. 10 is a view similar to FIG. 9 showing an undesired skewing of the entry die relative to the liner.

Referring now to FIG. 6, the mold 10 is shown exactly as is illustrated in FIG. 5, with the exception that the gap 82 has been increased to an undesired extent. As noted previously, if a gap larger than about 0.005 inch exists, fins will be formed and the casting eventually will be terminated. A large gap 82 such as that illustrated in FIG. 6 can be caused by improper alignment of the entry die 14 on the end of the copper liner 16 (tilting). Gaps also can be caused by the lack of a plane, parallel surface 80 on the end of the liner 16 (non-alignment of liner segments or lack of plane surface perpendicular to the casting direction). An undesirable gap also can be caused by misalignment of the entry die 14 relative to the liner 16; a linear offset is illustrated in FIG. 9, while a rotation, or skewed, offset is illustrated in FIG. 10. It has been observed through trial and error that a mismatch of as little as 0.010–0.012 inch between the through opening 12 in the liner 16 and the shoulder of the entry die 14 protruding past the edge of the through opening 12 in the liner 16 results in the formation of a gap 82, subsequent fins, and termination of the casting. The gap formation is caused by the first downward movement of the solidified casting skin against the protruding shoulder exerting a separating force across the joint between the entry die 14 and the liner 16.

Figure 7:
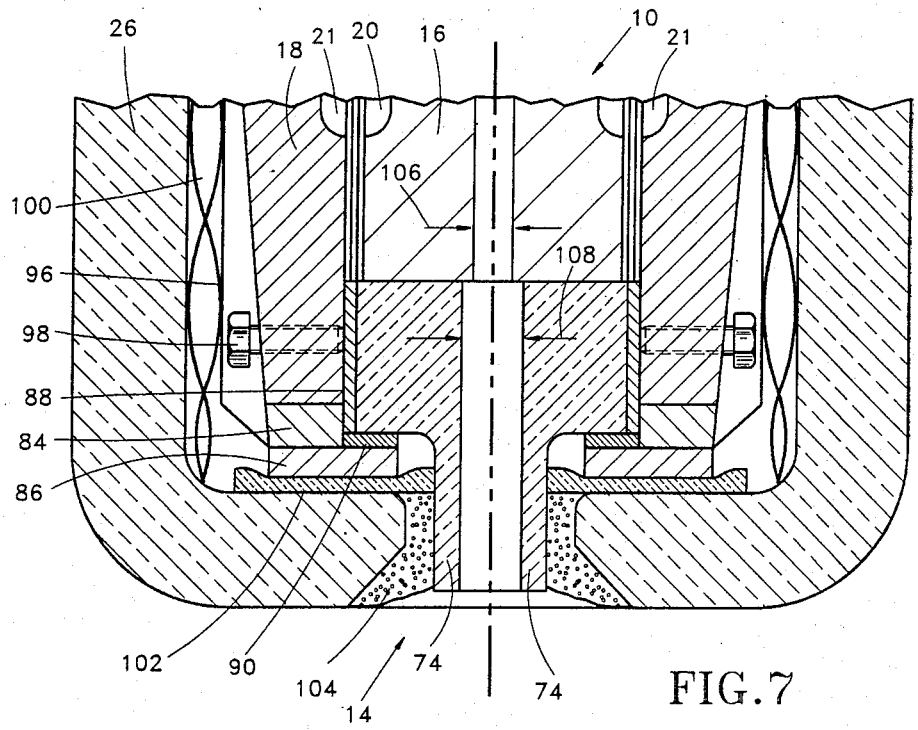
FIG. 7 is a view similar to FIG. 5 showing an undesired discontinuity between the entry die and the liner, wherein the entry die is larger than the liner.
Figure 8:
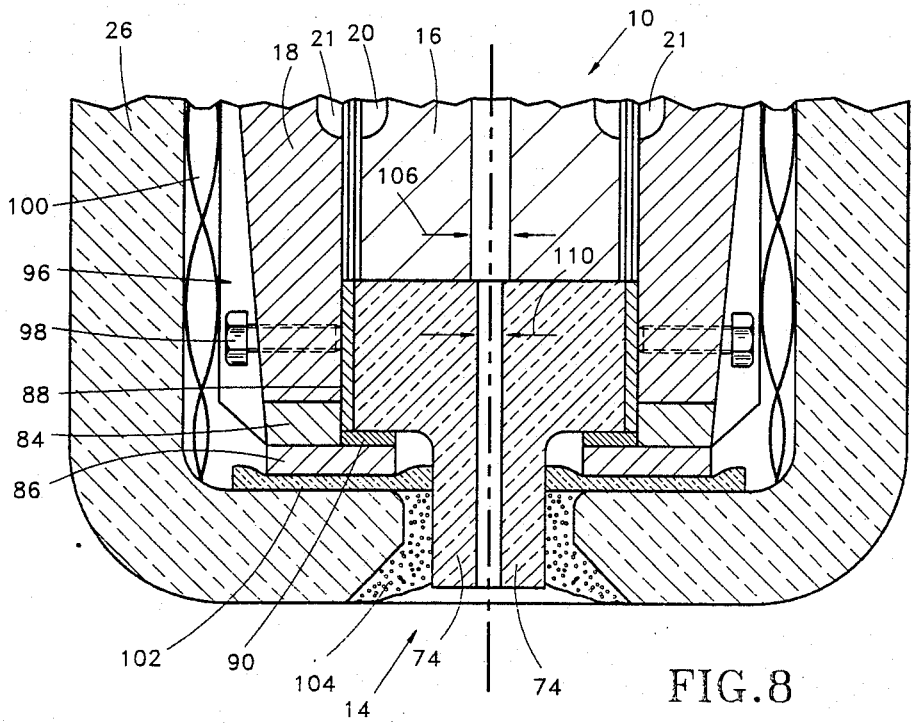
FIG. 8 is a view similar to FIG. 7 showing an undesired discontinuity between the entry die and the liner, wherein the entry die is smaller than the liner.

Referring now to FIGS. 7 and 8, FIG. 7 illustrates a condition where the entry die 14 is too large for the liner 16. The width of the through opening 12 within the liner 16 is indicated by the arrow 106, while the width of the through opening 12 within the entry die 14 is indicated by the arrow 108. As casting occurs, a shoulder is formed on the casting when liquid steel initially floods into the liner 16, and the shoulder cannot be pulled into the liner 16. Rupture of the casting and termination of the casting process will occur. The degree of permissible mismatch in the situation illustrated in FIG. 7 can be up to about 0.015 inch without deleterious effect.

In FIG. 8, the situation is illustrated where the entry die 14 has a smaller through opening 12 than the through opening 12 extending through the liner 16. The narrowed width of the through opening 12 extending through the entry die 14 is indicated in FIG. 8 by the arrow 110. With a mismatch as noted earlier of as little as 0.010–0.012 inch, upward movement of the mold relative to the casting causes a downward force on the intruding shoulder, producing either a gap or knocking a chip off of the shoulder. In either event, a fin will be formed with subsequent rupture of the casting and termination of the casting process.

The entry die 14 illustrated in FIGS. 1 and 5 typically has an overall length (from the surface 78 to the end of the projecting portion 74) of 2.75 inches, of which the body portion 72 is 1.5 inches long, and the projecting portion 74 is 1.25 inches long. These dimensions are sufficient for adequate lateral positioning of the entry die 14 by means of the screws 98, while permitting the projecting portions 74 to reach through the armor 26 to the liquid steel. Typically, the liner 16 will be about 20 inches long, so that the nozzle alone will constitute about 12% of the mold plus entry die composite length.

Figure 11:
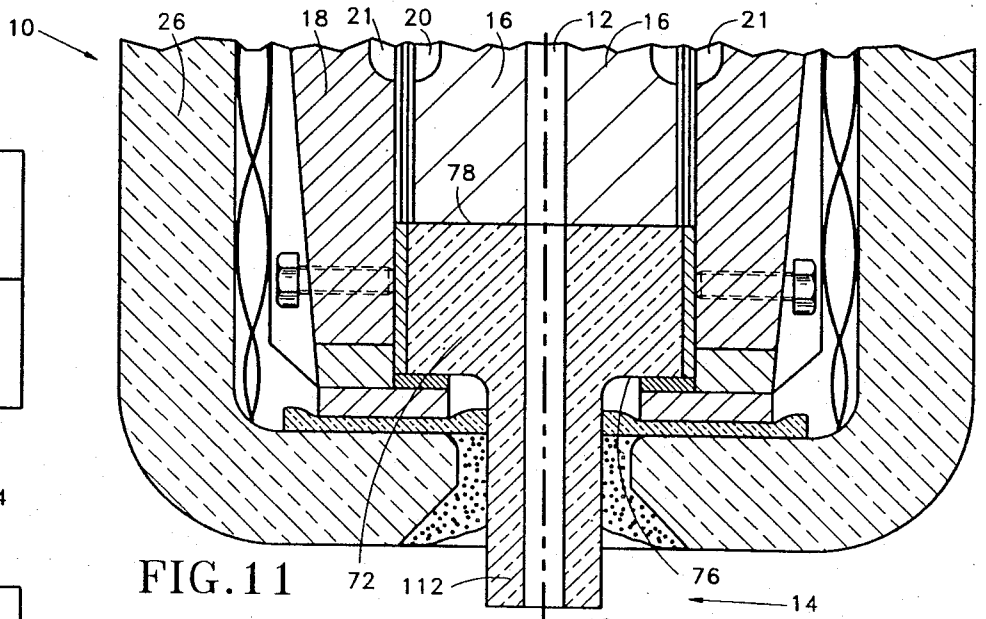
FIG. 11 is a view similar to FIG. 5 showing an entry die projecting beyond ceramic, protective armor provided for the mold.
Figure 12:
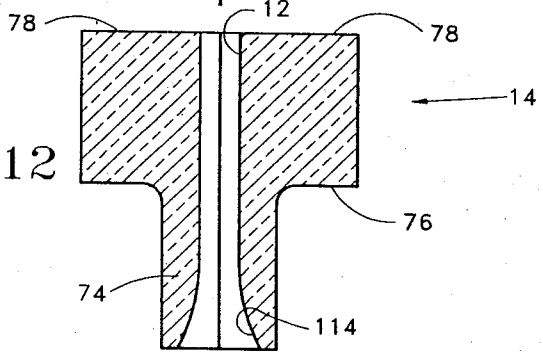
FIG. 12 is a view of an entry die similar to the entry die illustrated in FIG. 5 but showing a contoured inlet portion.

Referring to FIG. 11, the entry die 14 is shown in an extra long configuration, about 4.0 inches long overall. The body portion 72 is about 1.5 inches long, while the projecting portions 112 are about 2.5 inches long. The portions 112 project beyond the end of the ceramic armor 26 so as to enable the entry die 14 to reach deeper into the steel to avoid possible slag contamination from the ceramic armor 26. In FIG. 12, the entry die 14 is about 3.0 inches long overall, and it includes a curved, or flared, entry portion 114 that acts as a collector horn at very high casting speeds.

It is conceivable that the liner 16 could be as short as 12 inches, or even 8 inches for purposes of both economy (less material costs) and heat retention in the cast strip (less heat removal in the mold and higher rolling temperatures). Thus, the maximum portion of the liner plus entry die composite length occupied by the entry die would be up to 33%. A more likely figure would be about 20%, where a 3-inch entry die is used with a 12-inch liner.

EXAMPLE

Carbon steel (C-1008) was melted in an induction furnace and deoxidized with silicon and aluminum. Upon reaching approximately 3050° F., the casting mold with starter bar was immersed to a depth of approximately 12 inches in the melt and oscillation (one-quarter inch amplitude) of the mold was initiated. Continuous casting began. The casting speed was 60 inches per minute and the frequency of oscillation was 220 cpm. A substantial length of strip steel was successfully cast and showed the typical ripple marks produced by casting with an oscillating mold. The dimensions of the cast strip were a nominal 3 inches wide and one-half inch thick.

While the invention has been described with reference to its preferred embodiment, it will be understood that modifications and variations will occur to those skilled in the art. Such modifications and variations are intended to fall within the scope of the appended claims.

What is claimed is:

1. Apparatus for continuously casting steel from a melt of liquid steel, comprising:

a mold adapted to be partially immersed in the melt, the mold having upper and lower ends and including:

a through opening having a rectangular cross-section with a width substantially greater than it thickness, the through opening defining a longitudinal axis;

an entry die defining the lower part of the through opening, the entry die insulating the lower end of the mold;

a liner defining the remaining portion of the through opening, the liner serving to cool the liquid steel below its solidification temperature, the liner being joined to the entry die in end-to-end, abutting relationship with substantial surface-to-surface contact to form a smooth-sided through opening, the gap between the abutting ends of the liner and the entry die being about 0.005 inch or less and any lateral mismatch between the liner and the entry die being about 0.010 inch or less;

oscillating means for oscillating the mold along the longitudinal axis of the through opening; and starter means for starting solidification of the liquid steel within the through opening, the starter means adapted to be withdrawn upwardly from the through opening in order to initiate production of the strip steel.

2. The apparatus of claim 1, wherein the longitudinal axis is inclined at an angle to the horizontal within the range of 15–90 degrees.

3. The apparatus of claim 2, wherein the longitudinal axis is inclined at an angle to the horizontal of about 35 degrees.

4. The apparatus of claim 1, wherein the through opening is smoothly curved from the lower end of the mold to the upper end of the mold.

5. The apparatus of claim 1, wherein the entry die is made of a refractory material selected from the group consisting of fused silica, boron nitride, and alumina graphite.

6. The apparatus of claim 1, wherein the liner is made of copper or a copper alloy.

7. The apparatus of claim further comprising passages formed in the liner, the passages adapted to convey cooling fluid therethrough.

8. The apparatus of claim 7, further comprising a housing within which the liner is disposed, the passages being defined by grooves formed in the exterior surface of the liner at the interface between the liner and the housing.

9. The apparatus of claim 7, further comprising a housing within which the liner is disposed, the passages being defined by grooves formed in the exterior surface of the liner at the interface between the liner and the housing, and by grooves formed in the interior surface of the housing at the interface between the liner and the housing.

10. The apparatus of claim 1, further comprising ceramic protective armor within which the mold is disposed.

11. The apparatus of claim 10, wherein the armor has an opening adjacent the entry die, the armor surrounding the entry die and engaging it on that side of the entry die opposite the liner.

12. The apparatus of claim 11, wherein the entry die includes a projecting portion that defines the lowermost portion of the through opening, the projecting portion extending through the opening in the armor.

13. The apparatus of claim 1, further comprising a housing within which the liner and the entry die are disposed, and a plate surrounding at least a portion of the entry die, the plate being connected to the housing such that the plate can apply a compressive force to the entry die and the liner.

14. The apparatus of claim 13, wherein the armor includes an opening surrounding a portion of the entry die, the armor engaging the plate on that side of the plate opposite the liner, the apparatus further including (a) ceramic felt material disposed intermediate the plate and the armor, and (b) a ceramic slurry being disposed intermediate a portion of the entry die and the opening in the armor.

15. The apparatus of claim 1, wherein the entry die includes a projecting portion that defines the lowermost portion of the through opening, the projecting portion including a flared inlet.

16. The apparatus of claim 1, wherein the length of the entry die relative to the total length of the mold is within the range of 12–33 percent.

17. The apparatus of claim 26, wherein the length of the entry die relative to the total length of the mold is about 20 percent.

18. The apparatus of claim 1, wherein the through opening is smoothly tapered from a larger entrance end to a smaller exit end.

19. A method for continuously casting strip steel from a melt of liquid steel, comprising the steps of:

providing a mold having upper and lower ends and including a through opening having a rectangular cross-section with a width substantially greater than its thickness, the through opening defining a longitudinal axis, an entry die defining the lower part of the through opening, the entry die insulating the lower end of the mold, and a liner defining the remaining portion of the through opening, the liner serving to cool the liquid steel below its solidification temperature, the liner being joined to the entry die in end-to-end, abutting relationship with substantial surface-to-surface contact to form a smooth-sided through opening, the gap between the abutting ends of the liner and the entry die being about 0.005 inch or less and any lateral mismatch between the liner and the entry die being about 0.010 inch or less;

immersing the lower end of the mold in the melt;

oscillating the mold along the longitudinal axis of the through opening within the range of 100 to 500 cycles per minute, the frequency of mold oscillation being equal to 3.0 to 4.0 times the rate in inches per minute at which the solidified steel is withdrawn from the mold;

placing a starter bar within the through opening;

solidifying steel on the starter bar within the through opening; and pulling solidified steel from the upper end of the mold.

20. The method of claim 19, wherein the mold is oscillated continuously.

21. The method of claim 19, wherein the mold oscillation is characterized by a high forward velocity and long stroke length, a comparatively short reverse stroke length, and a dwell period after the reverse stroke.

22. The method of claim 19, comprising the additional step of inclining the mold at an angle to the horizontal within the range of 15–90 degrees.

23. The method of claim 22, wherein the mold is inclined at an angle to the horizontal of about 35 degrees.

24. The method of claim 19, wherein the through opening is smoothly curved from the lower end of the mold to the upper end of the mold.

25. The method of claim 19, comprising the additional steps of providing a housing within which the liner is disposed, forming grooves in the exterior surface of the liner at the interface between the liner and the housing, and cooling the liner by passing cooling fluid through the grooves.

26. The method of claim 25, comprising the additional steps of forming grooves in the interior surface of the housing at the interface between the liner and the housing, and passing cooling fluid through the grooves formed in the housing.

27. The method of claim 19, comprising the additional step of applying compressive force to the entry die and the liner.

28. The method of claim 27, wherein the compressive force is applied by disposing the liner and entry die within a housing, disposing a plate around at least a portion of the entry die, and connecting the plate to the housing.

* * * * *